US006688023B1

(12) United States Patent
Gwen

(10) Patent No.: US 6,688,023 B1
(45) Date of Patent: Feb. 10, 2004

(54) IDENTIFICATION BADGE WITH INTEGRAL NECK STRAP

(76) Inventor: Patrick Gwen, 3443 Leeland, Houston, TX (US) 77003

( * ) Notice: Subject to any disclaimer, the term of this patent is extended or adjusted under 35 U.S.C. 154(b) by 0 days.

(21) Appl. No.: 10/172,052

(22) Filed: Jun. 17, 2002

(51) Int. Cl.[7] ..... A44C 3/00; G09F 3/14
(52) U.S. Cl. ..... 40/1.6; 40/665; 40/674
(58) Field of Search ..... 40/1.5, 1.6, 633, 40/665, 674; 63/3, 3.2; 292/307 A; 224/610, 614, 623

(56) References Cited

U.S. PATENT DOCUMENTS 2,094,210 A * 9/1937 Graben ..... 40/665
3,793,644 A * 2/1974 Kellner ..... 2/48
4,509,277 A * 4/1985 Bolton ..... 40/1.5
4,793,486 A * 12/1988 Konopka et al. ..... 206/438
5,137,154 A * 8/1992 Cohen ..... 206/522
5,265,783 A * 11/1993 Iqbal ..... 224/610
5,759,328 A * 6/1998 Richwine et al. ..... 156/227
5,930,837 A * 8/1999 Anvar ..... 2/49.1
6,006,460 A * 12/1999 Blackmer ..... 40/300
6,116,653 A * 9/2000 Oberholzer et al. ..... 283/74

* cited by examiner

*Primary Examiner*—Brian K. Green
(74) *Attorney, Agent, or Firm*—Harrison & Egbert

(57) ABSTRACT

An identification badge having a front panel and a back panel affixed to the front panel. An extended section extends from the back panel and has a perforation pattern formed thereon. The perforation pattern defines a neck strap when the perforations are separated. The front panel is formed of a transparent material. An identification card can be positioned between the front and the back panel.

18 Claims, 3 Drawing Sheets

FIG. 1
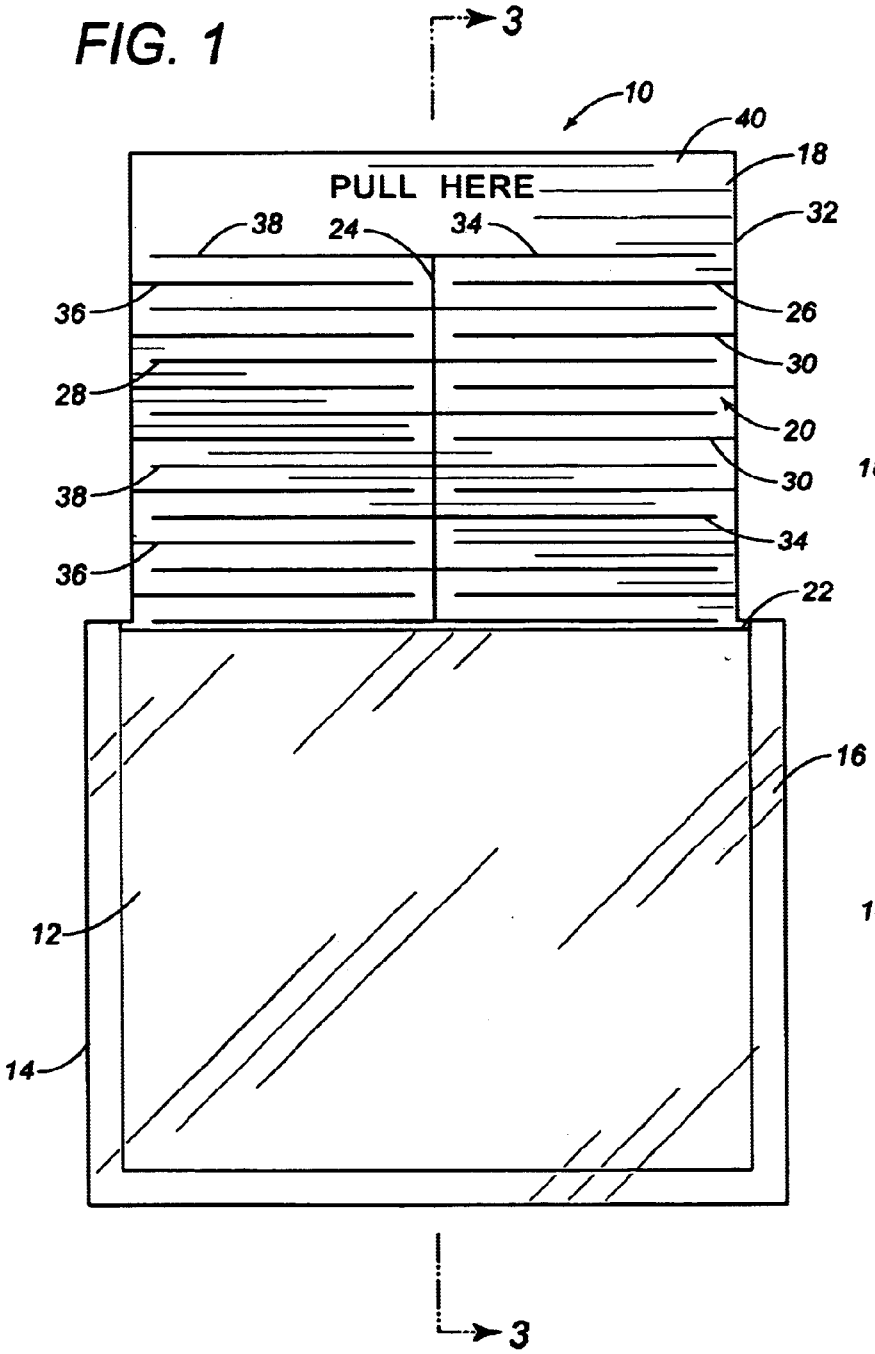
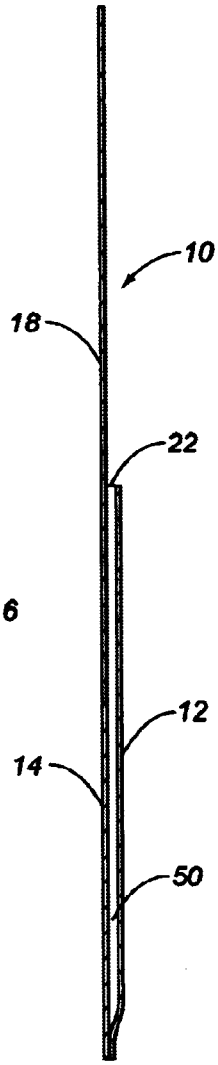
FIG. 3

FIG. 2
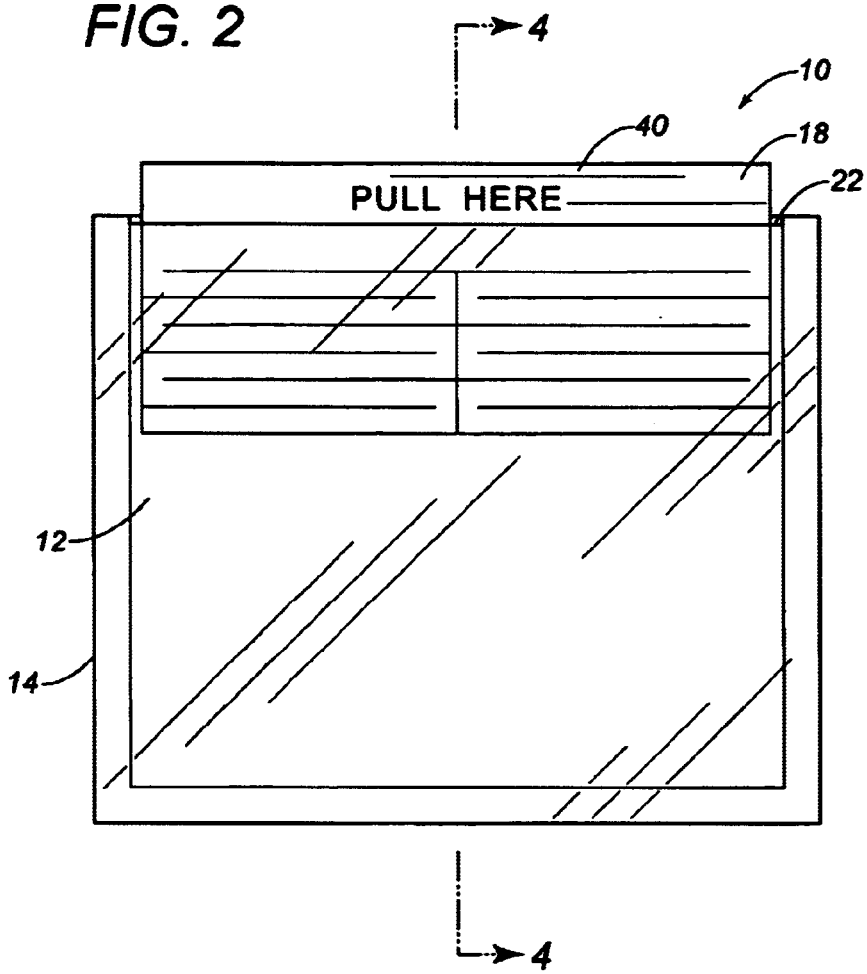
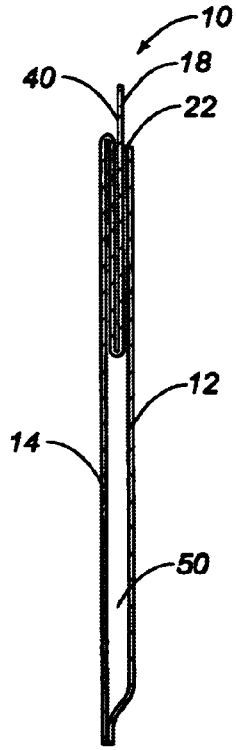
FIG. 4

IDENTIFICATION BADGE WITH INTEGRAL NECK STRAP

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to identification badges. More particularly, the present invention relates to items for displaying identification information which have neck straps attached thereto. Additionally, and furthermore, the present invention relates to identifications badges wherein the neck strap is integrally formed with the material of the identification badge.

BACKGROUND OF THE INVENTION

Identification badges are used in a wide variety of settings. Most commonly, identification badges are used for gatherings of persons that are unfamiliar with one another. For example, at a professional convention, it is quite common to hand identification badges to each of the attendees at the convention so that each of the attendees will be able to identify, by name, the other attendees. Typically, these identification badges will have the name of the person wearing the badge prominently displayed thereon. In other circumstances, other information regarding the person is also imprinted on the identification badge, such as the employer of the person wearing the identification badge or the home location of the wearer.

Conventional identification badges typically include a plastic pocket into which a name card can be inserted. The plastic pocket is typically attached to the clothing of the wearer by a variety of means. In one familiar instance, a metal clip is securely fastened to the back of the plastic pouch. This metal clip can then be secured to a pocket of the wearer, a tie of the wearer, a lapel of the wearer or other physical location. In other circumstances, a cloth neck strap can be riveted to the plastic pouch so as to extend around the neck of the wearer.

Unfortunately, each of these approaches is a relatively expensive approach to displaying the name on the person of the wearer, particularly, when it is intended to dispose of the name tag subsequent to the period of usage. The cost associated with placing an expensive metal item, such as a metal clip, onto the plastic pouch is inordinately expensive. In other circumstances, the riveting of the neck strap onto the material of the plastic pouch is an additional expense involving the use of metal, cloth and plastic.

Generally, metal items are incompatible with plastic items during the disposal and recycling of such identification badges. Modern recycling requires metal to be separated from plastic articles. As a result, since the metal clip is inherently secured to the plastic material of the identification badge, the identification badge cannot be easily disposed of and then recycled. Similarly, the combination of the cloth neck strap, along with the rivets and the plastic pouch is further difficult to dispose of. It would appear to be a waste of otherwise viable material to simply discard these relatively expensive identification badges subsequent to use.

The use of the metal clips can cause a variety of other problems. For example, when metal detectors are employed in particular conventions, the use of the metal clips will set off the alarm of such metal detectors. This causes an inconvenience for each of the attendees at the conference. In other circumstances, the metal clip may damage or wrinkle the item of clothing onto which it is attached. Still in other circumstances, the identification badge is removed on a nightly basis and separated from the person of the wearer. Often, the person will not reattach the identification badge and such badge will require replacement. In other circumstances, the small metal clip associated with such identification badges can become dislodged and the identification information lost. In all of these circumstances, the replacement of such identification badges is a relatively expensive procedure.

It is an object of the present invention to provide an identification badge which avoids the use of metal materials.

It is another object of the present invention to provide an identification badge in which the neck strap is integral to the pouch.

It is a further object of the present invention to provide an identification badge that can be easily and conveniently stored in large numbers in a single container.

It is a further object of the present invention to provide an identification badge which can be easily recycled subsequent to use.

It is still a further object of the present invention to provide an identification badge which avoids damage to the wearer's clothing and avoids accidental dislodgement.

It is still a further object of the present invention to provide an identification badge that is extremely inexpensive, easy to manufacture and easy to use.

These and other objects and advantages of the present invention will become apparent from a reading of the attached specification and appended claims.

BRIEF SUMMARY OF THE INVENTION

The present invention is an identification badge that comprises a front panel, and a back panel affixed to the front panel. One of the front panel and the back panel has an extended section. The extended section has a perforation pattern formed thereon. This perforation pattern defines a neck strap when the perforations of the pattern are separated.

In the present invention, the extended section is folded into a space between the front panel and the back panel. The extended section has a gripping portion extending outwardly of a periphery of the front panel.

In the present invention, the perforation pattern includes a central perforation line extending along a median of the extended section, a first serpentine perforation line extending along one side of the central perforation line, and a second serpentine perforation line extending along an opposite side of the central perforation line. Each of the first and second serpentine perforation lines connects with the central perforation line along the length of the central perforation line.

In the present invention, the extended portion is folded into a V-shaped within the space between the front panel and the back panel. The front panel is sealed against the back panel around a portion of the periphery of the back panel. The front and back panels define a badge-receiving slot formed between an unsealed area between the front panel and the back panel. The extended portion is integrally connected to the back panel. The back panel and the extended section are each formed of a tear-resistant polymeric material. The front panel is of a transparent material.

In the present invention, an identification card can be removably positioned between the front panel and the back panel. The identification card has identification information imprinted thereon and facing the front panel.

BRIEF DESCRIPTION OF THE SEVERAL VIEWS OF THE DRAWINGS

FIG. 1 is a frontal view of the identification badge of the present invention in a fully extended position.

FIG. 2 is a frontal view of the identification badge of the present invention in a folded position prior to use.

FIG. 3 is a cross-sectional view taken across lines 3—3 of FIG. 1.

FIG. 4 is a cross-sectional view taken across lines 4—4 of FIG. 2.

DETAILED DESCRIPTION OF THE INVENTION

Figure 5:
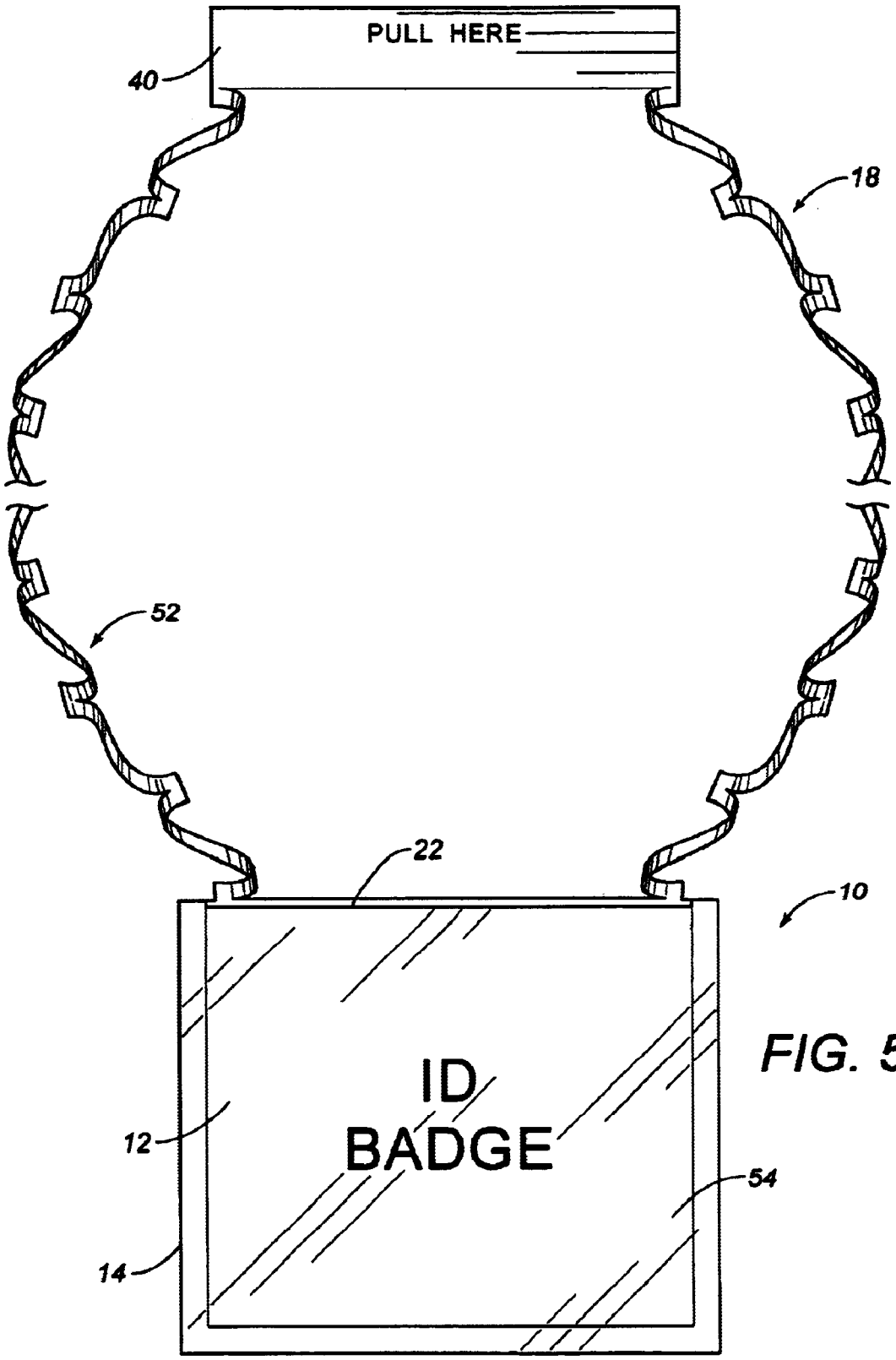
FIG. 5 shows the identification badge of the present invention with the perforations having been separated so as to form a neck strap therefrom.

Referring to FIG. 1, there is shown at 10 the identification badge in accordance with the teachings of the preferred embodiment of the present invention. The identification badge 10 includes a front panel 12 and a back panel 14. The back panel 14 is affixed to the front panel 12 along the periphery 16. The back panel 14 has an extended section 18 extending therefrom. The extended section 18 has a perforation pattern 20 formed therein. This perforation pattern 20 will define a neck strap when the perforations of this pattern are separated. As used herein, the terms "perforation" or "perforated" can also includes pre-cut surfaces and the like.

In the present invention, it can be seen that the front panel 12 is formed of a transparent material. In normal use, a paper identification card will be inserted behind the front panel 12 and through a slot 22 formed between the front panel 12 and the back panel 14. Identification information will face outwardly through the transparent material of the front panel 12. The front panel 12 will be typically heat sealed or sonically welded around three sides of its periphery to the back panel 14. However, it is possible that stapling could be used so as to secure the periphery of the front panel 12 to the back panel 14.

The extended portion 18 is integrally formed with the back panel 14. In an alternative form of the present invention, it is possible that the extended section 18 can be simply connected to one of either the front panel 12 or the back panel 14. However, in the embodiment shown in FIG. 1, the extended section 18 is simply formed with the back panel 14. The extended section 18 is illustrated as extending outwardly of the periphery of the front panel 12.

The extended section 18 has perforation pattern 20 extending thereover and therethrough. This perforation pattern includes a central perforation line 24 extending for at least a portion of the length of the extended section 18. A first serpentine perforation line 26 extends along one side of the central perforation line 24. Similarly, a second serpentine perforation line 28 extends along an opposite side of the central perforation line 24. Each of the serpentine perforation lines 26 and 28 connect with the central perforation line 24 along the length of the central perforation line 24.

The first serpentine perforation line 26 includes a plurality of inwardly extending perforation lines 30 extending in parallel relationship from side 32 of the extended portion 18 and terminating in spaced relationship from the central perforation line 24. A plurality of outwardly extending perforation lines 34 extend in parallel spaced relationship in an alternating pattern with the perforation lines 30. Each of the outwardly extending perforation lines 34 has an end communicating with the central perforation line 24 and terminating in spaced relationship from side 32.

Similarly, the second serpentine pattern has a configuration generally matching the first serpentine perforation pattern 26. In particular, the second serpentine perforation pattern 28 has a plurality of inwardly extending perforation lines 36 and a plurality of outwardly extending perforation lines 38. A central intact portion 40 is formed at the opposite end of the extended section 18 from the front panel 12. This intact portion 40 includes the words "Pull Here" imprinted thereon. As such, the intact portion 40 will provide a gripping area whereby the user can pull the perforated extended portion 18 outwardly from the interior of the identification badge 10.

FIG. 2 shows the identification badge 10 of the present invention in its condition prior to use. The identification badge 10 in FIG. 2 is shown as it appears prior to the installation of the identification card therein. For example, the identification card 10 can be handed to users at a convention and can be stored in a relatively large container in a flattened condition. In particular, in FIG. 2, it can be seen that the extended portion 18 is folded into the space between the front panel 12 and the back panel 14. The intact portion 40 extends outwardly from the slot 22 of the identification badge 10. The words "Pull Here" will inform the user of his or her need to pull the extended portion 18 outwardly therefrom. The remainder of the extended portion 18 is folded in a V-shape within the interior space between the front panel 12 and the back panel 14.

FIG. 3 is a cross-sectional view of the device 10 shown in FIG. 1. In particular, it can be seen in FIG. 3 the configuration of the front panel 12 and the back panel 14. The extended portion 18 is integrally formed with the back panel 14 and extends outwardly therefrom. Slot 22 is formed so as to allow for the receipt of an identification card into the space 50 between the front panel 12 and the back panel 14.

FIG. 4 shows how the extended portion 18 is folded in a V-shaped within the interior space 50 between the front panel 12 and the back panel 14. The gripping portion 40 is illustrated as extending outwardly of the slot 22. Since the extended portion 18 is folded in a neat V-shape, the device 10 of the present invention can be easily stowed in large numbers in a flat condition.

FIG. 5 illustrates the identification badge 10 of the present invention in its deployed position ready for use. In particular, FIG. 5 shows that the gripping portion 40 has been pulled outwardly so that the perforations have separated. A neck strap 50 is formed by the strips of plastic material that have been separated from the perforations. Neck strap 52 should have a diameter suitable for fitting around a human neck and, in particular, for fitting over a human head. Since the extended portion 18, along with the neck strap 52 are formed of a tear-resistant polymeric material, it is unlikely that the identification badge 10 will become separated from the wearer during ordinary use. In FIG. 5, it can be seen that the identification card 54 has been inserted into the slot 22 between the front panel 12 and the back panel 14. As a result, identification information is easily displayed outwardly from the identification badge 10 of the present invention.

It can be seen that the present invention avoids all use of metal materials. As a result, the device 10 can be easily manufactured of a polymeric material in a very fast and efficient manner. By avoiding such metal materials, the badge 10 can be easily disposed of subsequent to use without the need for special recycling efforts. Because of the small expense associated with the identification badge 10 of the present invention, there are only minimal problems associated with the accidental misplacement or loss of the identification badge 10. The use of the neck strap 52 will avoid any loss of the neck strap during use.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An identification badge comprising:

a front panel; and a back panel affixed to said front panel, one of said front panel and said back panel having an extended section, said extended section having a perforation pattern formed thereon, said perforation pattern defining a neck strap when the perforations of said perforation pattern are separated, said extended section being folded into a space between said front panel and said back panel.

2. The badge of claim 1, said extended section having a gripping portion extending outwardly of a periphery of said front panel.

3. The badge of claim 1, said perforation pattern comprising:

a central perforation line extending along a median of said extended section;

a first serpentine perforation line extending along one side of said central perforation line; and a second serpentine perforation line extending along an opposite side of said central perforation line.

4. The badge of claim 3, each of said first and second serpentine perforation lines connecting with said central perforation line along the length of said central perforation line.

5. The badge of claim 1, said extended portion being folded in a V-shaped configuration within said space.

6. The badge of claim 1, said front panel being sealed against said back panel around a portion of a periphery of said back panel.

7. The badge of claim 6, said front and back panels defining a badge-receiving slot formed between an unsealed area between said front panel and said back panel.

8. The badge of claim 1, said extending section being integrally connected to said back panel.

9. The badge of claim 8, said back panel and said extended section being formed of a tear-resistant polymeric material.

10. The badge of claim 1, said front panel being of a transparent material.

11. The badge of claim 10, further comprising:

an identification card removably positioned between said front panel and said back panel, said identification card having identification information imprinted thereon and facing said front panel.

12. An identification device comprising:

a front panel; and a back panel affixed to said front panel, one of said front panel and said back panel having an extended section, said extended section having a perforation means formed thereon, said perforation means for forming a neck strap when the perforations therein are separated, said extended section being folded into a space between said front panel and said back panel.

13. The device of claim 12, said neck strap having a diameter suitable for allowing a human head to pass therethrough.

14. The device of claim 12, said perforation pattern comprising:

a central perforation line extending along a median of said extended section;

a first serpentine perforation line extending along one side of said central perforation line; and a second serpentine perforation line extending along an opposite side of said central perforation line.

15. The device of claim 14, each of said first and second serpentine perforation lines connecting with said central perforation line along a length of said central perforation line.

16. The device of claim 15, said first serpentine perforation line comprising:

a plurality of inwardly extending perforation lines extending in parallel spaced relationship from one side of said extended section and terminating spaced from said central perforation line; and a plurality of outwardly extending perforation lines extending in parallel spaced relationship in an alternating pattern with perforation lines of said plurality of inwardly extending perforation lines, said plurality of outwardly extending perforation lines each having one end communicating with said central perforation line and terminating spaced from said one side.

17. The device of claim 16, said second serpentine perforation line comprising:

a plurality of inwardly extending perforation lines extending in parallel spaced relationship from said opposite side of said extended section and extending so as to be spaced from said central perforation line; and a plurality of outwardly extending perforation lines extending in parallel spaced relationship in an alternating pattern with perforation lines of said plurality of inwardly extending perforation lines of said second serpentine perforation line, said plurality of outwardly extending perforation lines of said second serpentine perforation line each having one end communicating with said central perforation line and terminating spaced from said opposite side of said extended section.

18. The device of claim 12, further comprising:

an identification card positioned between said front panel and said back panel, said identification card having identification information imprinted thereon and facing said front panel.

* * * * *